US007138992B2

(12) United States Patent
Nakamura

(10) Patent No.: US 7,138,992 B2
(45) Date of Patent: Nov. 21, 2006

(54) METHOD OF CALIBRATING LUMINANCE OF DISPLAY, DRIVING CIRCUIT OF DISPLAY EMPLOYING SAME METHOD AND PORTABLE ELECTRONIC DEVICE PROVIDED WITH SAME DRIVING CIRCUIT

(75) Inventor: Masafumi Nakamura, Saitama (JP)

(73) Assignee: NEC Corporation, Tokyo (JP)

( * ) Notice: Subject to any disclaimer, the term of this patent is extended or adjusted under 35 U.S.C. 154(b) by 159 days.

(21) Appl. No.: 10/232,701

(22) Filed: Sep. 3, 2002

(65) Prior Publication Data

US 2003/0043137 A1 Mar. 6, 2003

(30) Foreign Application Priority Data

Sep. 3, 2001 (JP) ..... 2001-266432

(51) Int. Cl.
*G09G 5/00* (2006.01)

(52) U.S. Cl. ..... 345/207; 345/76; 345/102; 345/211

(58) Field of Classification Search ..... 345/84, 345/207, 90, 76–83, 102, 211
See application file for complete search history.

(56) References Cited

U.S. PATENT DOCUMENTS 4,462,069 A * 7/1984 Becky ..... 363/23
5,786,801 A * 7/1998 Ichise ..... 345/102
5,814,947 A * 9/1998 Brownell ..... 315/169.3
6,144,359 A * 11/2000 Grave ..... 345/102
6,518,561 B1 * 2/2003 Miura ..... 250/221
6,618,045 B1 * 9/2003 Lin ..... 345/207
6,717,559 B1 * 4/2004 Weindorf ..... 345/82

FOREIGN PATENT DOCUMENTS

| | | |
|---|---|---|
| JP | 4-127570 | 4/1992 |
| JP | 8-76864 | 3/1996 |
| JP | 10-319910 | 12/1998 |
| JP | 2001-202053 | 7/2001 |
| WO | WO 99/04562 | 1/1999 |

* cited by examiner

*Primary Examiner*—Richard Hjerpe
*Assistant Examiner*—Kimnhung Nguyen
(74) *Attorney, Agent, or Firm*—Young & Thompson

(57) ABSTRACT

A method for calibrating luminance of a display is provided which is capable of reducing power consumption in simple and low-cost configurations without putting a load on a CPU adapted to control each component of a portable electronic device. An amount of light corresponding to an amount of light incident on an organic EL display is measured and an output voltage is divided by an output voltage dividing section based on a light amount voltage being a result from the measurement and an output voltage is adjusted by the organic EL display power source based on the divided voltage.

12 Claims, 5 Drawing Sheets

| state | amount of light received | Q1 | Q2 | voltage dividing ratio |
|---|---|---|---|---|
| ST1 | 0~TH1 | off | off | R2/(R1+R2) |
| ST2 | TH1~TH2 | on | off | RX1/(R1+RX1) |
| ST3 | TH2~ | on | on | RX2/(R1+RX2) |

23
power source
22
42
43
44
45
52
controller
oscillator
51
41
53
54
$V_{REF}$
$V_{OUT}$
61
R1
63
R3
R2
62
64
R4
Q1
Q2
21
organic EL display device
$T_c$
$T_a$
$V_L$
$T_b$
$S_c$
71;switch
24
optical sensor

METHOD OF CALIBRATING LUMINANCE OF DISPLAY, DRIVING CIRCUIT OF DISPLAY EMPLOYING SAME METHOD AND PORTABLE ELECTRONIC DEVICE PROVIDED WITH SAME DRIVING CIRCUIT

BACKGROUND OF THE INVENTION

1. Field of the Invention

The present invention relates to a method for calibrating luminance of a display, a driving circuit for the display employing the method and portable electronic devices and more particularly to the method for calibrating the display made up of light emitting devices, the driving circuit for the display employing the method and the portable electronic devices being equipped with the driving circuit for the display.

The present application claims priority of Japanese Patent Application No.2001-266432 filed on Sep. 3, 2001, which is hereby incorporated by reference.

2. Description of the Related Art

FIG. 7 is a block diagram showing an example of configurations of a conventional driving circuit of a display. FIG. 8 is a perspective view showing an appearance of a portable cellular phone being equipped with the conventional driving circuit of the display.

The conventional driving circuit of the display includes an organic electroluminescence (EL) display device 1, an organic EL display power source 2, a power source 3, an optical sensor 4, an analog/digital (A/D) converting section 5, a voltage controlling section 6, a key inputting device 7, and a memory 8.

The organic EL display device 1 is constructed of an organic EL device using an organic material such as a derivative of stilbene or a like and, as shown in FIG. 8, is mounted on a surface of an approximate central portion inside an upper portion 11*a* of a housing 11 of the portable cellular phone. The organic EL display power source 2 is made up of a DC/DC converter or a like and, based on a specified supply voltage being fed from the power source 3, produces a high voltage to drive the organic EL display device 1 and feeds the organic EL display device 1. The power source 3 is made up of a battery, a dry cell, or a like and feeds a specified supply voltage to each component of the portable cellular phone. The optical sensor 4 is made up of a solar cell or a like and, as shown in FIG. 8, is mounted on a surface in a vicinity of a portion existing left under the organic EL display device 1 inside the upper portion 11*a* of the housing 11 of the portable cellular phone. The optical sensor 4 measures an amount of light being substantially proportional to that of light incident on the organic EL display device 1 and outputs an analog light amount voltage $V_L$ corresponding to the amount of light.

The A/D converting section 5 converts the analog light amount voltage $V_L$ into digital light amount data $D_L$. The voltage controlling section 6, based on the digital light amount data $D_L$, controls the organic EL display power source 2. The key inputting device 7, as shown in FIG. 8, is mounted inside a lower portion 11*b* of the housing 11 of the portable cellular phone and is made up of a ten-key and a variety of buttons. The ten-key is used for inputting a telephone number of a person receiving a telephone call. Each of the various buttons is used to issue an instruction for permission and termination of a telephone conversation, switching-over of display, and amendment of current date and calibration of the organic EL display device 1. The memory 8 is made up of semiconductor memories such as RAM, ROM, or a like in which data (correspondence table or converting expression) required for the voltage controlling section 6 to control the organic EL display power source 2 is stored in advance.

Next, operations of calibrating luminance of the organic EL display device 1 based on an amount light incident from an outside in the driving circuit of the organic EL display device 1 having the above configurations are described. The organic EL display device 1 has a characteristic that its luminance changes approximately in proportion to a change of an applied voltage. Moreover, generally, luminance required for a user of the portable cellular phone to recognize contents displayed in the organic EL display device 1 is changed in proportion to a change in an amount of light incident from the outside. That is, in strong light from the outside, unless luminance of the organic EL display device 1 is sufficiently raised, the user cannot recognize displayed contents, however, in the outdoors during the night or in a dimly lit room, even if luminance of the organic EL display device 1 is lowered, the user can sufficiently recognize the displayed contents.

In the above example, the optical sensor 4 measures an amount of light substantially in proportion to light incident on the organic EL display device 1 and outputs the analog light amount voltage $V_L$ corresponding to an amount of the light. The A/D converting section 5 converts analog light amount voltage $V_L$ into digital light amount data $D_L$. As a result, the voltage controlling section 6, based on digital light amount data $D_L$ and on data being stored in the memory 8, controls the organic EL display power source 2 so that a voltage being as low as possible to reduce power consumption is fed to the organic EL display device 1. Thus, according to the example, luminance of the organic EL display device 1 can be calibrated to its minimum level which enables power consumption to be reduced.

In the conventional driving circuit of the organic EL display device 1, the voltage controlling section 6 is required to periodically control the organic EL display power source 2. If a CPU (Central Processing Unit) adapted to control each component making up a portable cellular phone has to control a function of the voltage controlling section 6, there is a problem in that a load put on the CPU becomes large. If the voltage controlling section 6 is mounted independently from the CPU, the portable cellular phone becomes high-priced.

Moreover, in the conventional driving circuit for the organic EL display device 1, in order for the voltage controlling section 6 to control the organic EL display power source 2, the A/D converting section 5 converts the analog light amount voltage $V_L$ corresponding to an amount of light to the digital light amount data $D_L$ corresponding to the amount of the light and the memory 8 stores, in advance, data required for the voltage controlling section 6 to control the organic EL display power source 2. Therefore, the conventional driving circuit for the organic EL display device 1 has a problem in that, since both the A/D converting section 5 and the memory 8 have to be mounted therein, circuit configurations of the portable cellular phone become complicated and high-priced. The above problems occur also in other portable electronic devices using a battery or a dry cell as a power source such as notebook, palm-sized, and pocket-sized computers, PDA (Personal Digital Assistant), PHS (Personal Handy-phone System) or a like.

SUMMARY OF THE INVENTION

In view of the above, it is an object of the present invention to provide a method for calibrating luminance of a display which is capable of reducing power consumption in simple and low-cost configurations without putting a load on a CPU as a controller, a driving circuit of display employing a same method and a portable electronic device provided with a same driving circuit.

According to a first aspect of the present invention, there is provide a method for calibrating luminance of a display including:

a step of measuring an amount of light corresponding to an amount of light incident on the display whose luminance is changed depending on an applied voltage;

a step of dividing the applied voltage based on a voltage obtained as a result of the measurement; and a step of adjusting the applied voltage based on the divided voltage.

In the foregoing, a preferable mode is one wherein the divided voltage is set at a specified value based on a signal fed from an outside.

Also, a preferable mode is one wherein the display is any one of an organic electroluminescence display, a display made up of a Light-Emitting Diode (LED), a display made up of a Vacuum Fluorescent Display (VFD), and a Field Emission Display (FED).

According to a second aspect of the present invention, there is provided a driving circuit for the display including;

an optical sensor to measure an amount of light corresponding to an amount of light incident on the display whose luminance is changed depending on an applied voltage and to output a voltage corresponding to the measured amount of light;

a power source section to produce the applied voltage;

a voltage dividing section to divide the applied voltage based on the voltage corresponding to the measured amount of light and to feed the divided voltage to the power source section; and wherein the power source section calibrates the applied voltage based on the divided voltage.

In the foregoing, a preferable mode is one wherein the voltage dividing section is made up of a plurality of resistors, and one transistor or a plurality of transistors each having a different cut-off voltage and wherein the voltage dividing section outputs the different divided voltage by turning ON and OFF the transistor based on the voltage corresponding to the measured amount of light to make different a synthetic resistance value produced by the plurality of resistors.

Also, a preferable mode is one that wherein includes a switch being placed between an output terminal of the optical sensor and an input terminal of the voltage dividing section to set the divided voltage to a specified value based on a signal fed from an outside.

Also, a preferable mode is one wherein the display is any one of an organic electroluminescence display, a display made up of a Light-Emitting Diode (LED), a display made up of a Vacuum Fluorescent Display (VFD), and a Field Emission Display (FED).

According to a third aspect of the present invention, there is provided a portable electronic device being provided with the driving circuit for the display described above.

Also, a preferable mode is one wherein the portable electronic device being a portable cellular phone or a simplified portable cellular phone being equipped with the driving circuit for the display described above and wherein a signal is fed when the portable electronic device is in a silent (manner) mode to cause an incoming call not to ring, in a conversation mode to cause a telephone conversation to be taken between a user of the portable electronic device and another user of the portable electric device receiving a call, or in a waiting mode in which, though power is turned ON, the user is waiting for an incoming signal without performing operations, or when the user is operating the portable electronic device.

With the above configuration, an amount of light corresponding to an amount of light incident on a display whose luminance is changed depending on an applied voltage is measured and an applied voltage is divided based on a voltage obtained as a result from the measurement and an applied voltage is adjusted based on the divided voltage. This enables a method for calibrating luminance of display to be achieved which is capable of reducing power consumption in simple and low-cost configurations without putting a load on a CPU adapted to control each portion of portable electronic devices.

With another configuration, since the divided voltage is set to a specified value based on a signal fed from an outside, power consumption can be reduced more.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
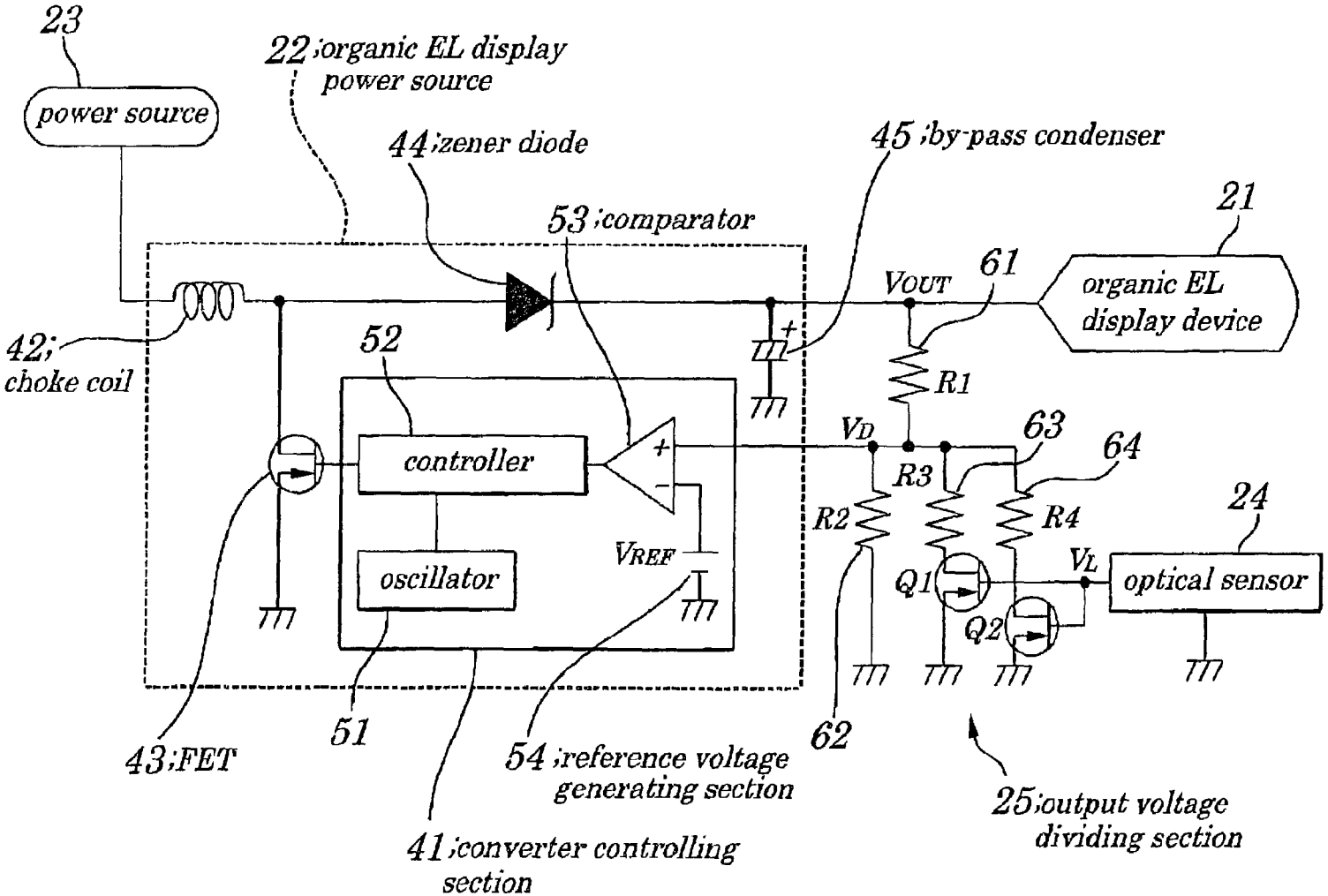
FIG. 1 is a schematic block diagram showing configurations of a driving circuit for a display employing a method for calibrating luminance of the display according to a first embodiment of the present invention.
Figure 2:
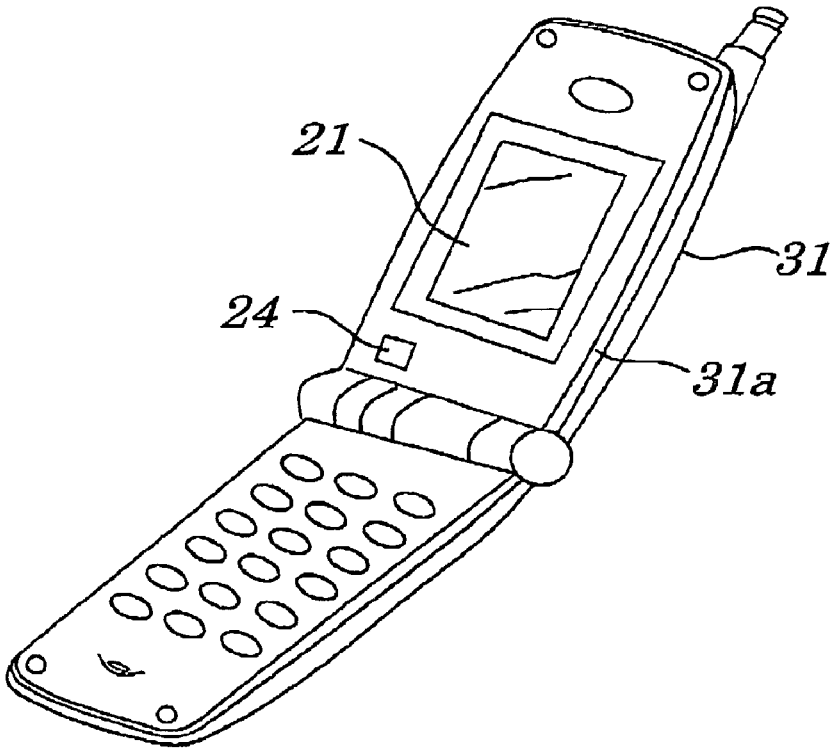
FIG. 2 is a perspective view showing an appearance of a portable cellular phone being equipped with the driving circuit for the display according to the first embodiment of the present invention.

FIG. 1 is a schematic block diagram for showing configurations of a driving circuit for a display employing a method for calibrating luminance of the display according to a first embodiment of the present invention. FIG. 2 is a perspective view showing an appearance of a portable cellular phone being equipped with the driving circuit of the display according to the first embodiment.

The driving circuit for the display of the first embodiment includes an organic EL display device 21, an organic EL display power source 22, a power source 23, an optical sensor 24, and an output voltage dividing section 25.

The organic EL display device 21 is made up of an organic EL device using an organic material such as a derivative of stilbene or a like and, as shown in FIG. 2, is mounted on a surface of an approximate central portion inside an upper portion 31*a* of a housing 31 of a portable cellular phone. The organic EL display power source 22 is made up of a DC/DC converter, based on a divided voltage $V_D$ fed from the output voltage dividing section 25, produces a high output voltage $V_{OUT}$ used to drive the organic EL display device 21 from a specified supply voltage fed from the power source 23 and supplies it to the organic EL display device 21. The organic EL display power source 22 monitors and adjusts the divided voltage $V_D$ obtained by dividing the output voltage $V_{out}$ so that the output voltage $V_{OUT}$ does not drop with an increase of a current flowing through the organic EL display device 21. The power source 23 is made up of a battery or a dry cell and feeds a specified supply voltage to each component of the portable cellular phone. The optical sensor 24 is made up of a solar cell and, as shown in FIG. 2, is mounted on a surface in a vicinity of a portion existing left under the organic EL display device 21 inside the upper portion 31*a* of the housing 31 of the portable cellular phone. The optical sensor 24 measures an amount of light being substantially proportional to that of light incident on the organic EL display device 21 and outputs an analog light amount voltage $V_L$ corresponding to an amount of light (this voltage becomes higher as an amount of received light increases). The output voltage dividing section 25 divides an output voltage $V_{OUT}$, based on the analog light amount voltage $V_L$ corresponding to the amount of light, and feeds the divided voltage $V_D$ the organic EL display power source 22.

The organic EL display power source 22 includes a converter controlling section 41, choke coil 42, an FET 43, a Zener diode 44, and a by-pass condenser 45. The converter controlling section 41 turns ON and OFF the FET 43 so that the divided voltage $V_D$ becomes equal to a reference voltage $V_{REF}$. The choke coil 42 prevents a high-frequency component being superimposed on the output voltage $V_{OUT}$ to drive the organic EL display device 21 from leaking on a side of the power source 23. The FET 43 is made up of, for example, an N-channel MOS transistor or a GaAs (Gallium Arsenide) FET and is turned ON and OFF by the converter controlling section 41 and then produces the output voltage $V_{OUT}$. The Zener diode 44 prevents the output voltage $V_{OUT}$ from dropping to less than a specified value The by-pass condenser 45 smoothes a low-frequency component being superimposed on the output voltage $V_{OUT}$.

The converter controlling section 41 includes an oscillator 51, a controller 52, a comparator 53, and a reference voltage generating section 54. The oscillator 51 produces an oscillation signal having a specified frequency. The controller 52, based on a comparison signal fed from the comparator 53, turns ON and OFF the FET 43 in synchronization with the oscillation signal. The comparator 53 compares the reference voltage $V_{REF}$ to be fed from the reference voltage generating section 54 with the divided voltage $V_D$ to be fed from the output voltage dividing section 25 and outputs a result from the comparison as a comparison signal. The reference voltage generating section 54 is made up of a constant voltage power source or a like and generates the reference voltage $V_{REF}$.

Figure 3:
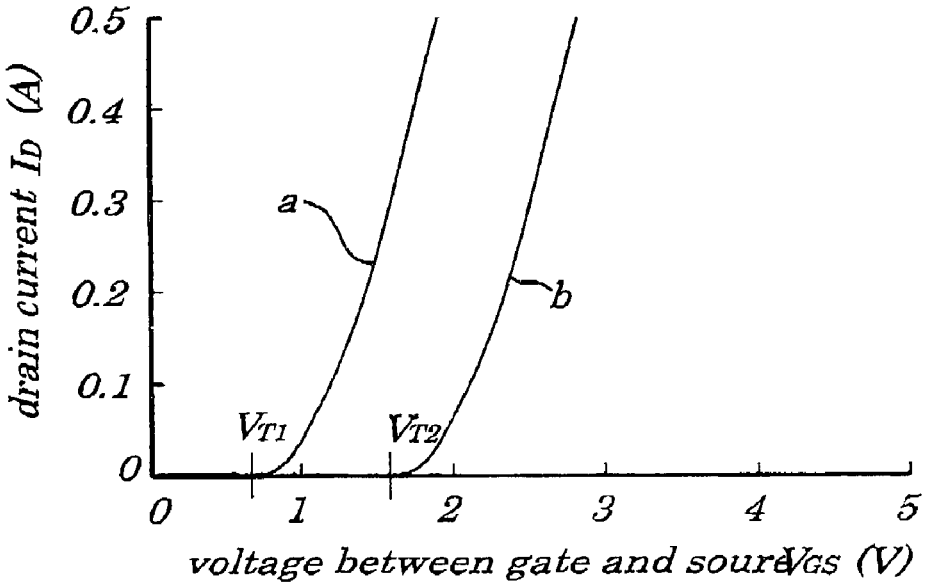
FIG. 3 is a graph showing an example of a characteristic of a drain current to a voltage between a gate and a source of each of FETs (Field Effect Transistors) according to the first embodiment of the present invention.

The output voltage dividing section 25 is made up of resistors 61 to 64 respectively having resistance values R1 to R4 and FETs Q1 and Q2. One end of the resistor 61 is connected to an input terminal of the organic EL display device 21 and another end of the resistor 61 is connected to a positive input terminal of the comparator 53 making up the converter controlling section 41. One end of the resistor 62 is connected to a positive input terminal of the comparator 53 and another end of the resistor 62 is connected to a ground terminal. One end of the resistor 63 is connected to a positive input terminal of the comparator 53 and another end of the resistor 63 is connected to a drain of the FET Q1. One end of the resistor 64 is connected to a positive input terminal of the comparator 53 and another end of the resistor 64 is connected to a drain of the FET Q2. Each of the FETs Q1 and Q2 is made up of, for example, an N-channel MOS transistor or a GaAs FET to each gate of which the analog light amount voltage $V_L$ corresponding to an amount of light is fed from the optical sensor 24 and each source of which is grounded. FIG. 3 is a graph showing an example of a characteristic of a drain current $I_D$ to a voltage $V_{GS}$ between a gate and a source of each of FETs Q1 and Q2. In FIG. 3, a curve "a" shows a characteristic of the FET Q1 and a curve "b" shows a characteristic of the FET Q2. As is apparent from FIG. 3, a gate cut-off voltage $V_{T1}$ of the FET Q1 is different from a gate cut-off voltage $V_{T2}$ of the FET Q2.

Figures 4, 5:
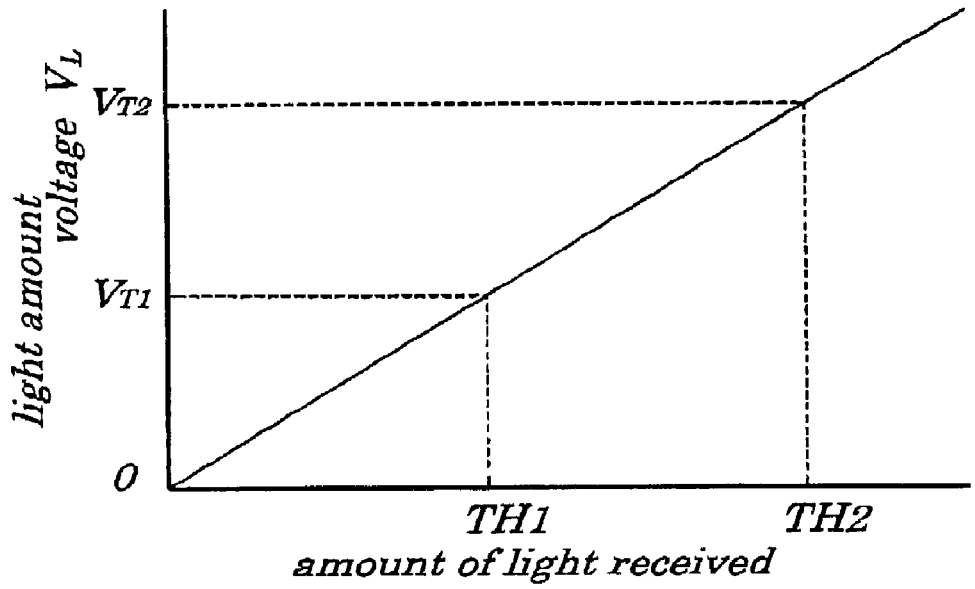
FIG. 4 is a graph showing an example of a relation of a characteristic of a voltage corresponding to an amount of light to an amount of light received by an optical sensor to gate cut-off voltages of FETs according to the first embodiment of the present invention.
FIG. 5 is a table showing an example of a relation among an amount of light received by the optical sensor, ON/OFF state of the FETs, and dividing ratio of an output voltage $V_{OUT}$ according to the first embodiment of the present invention.

Next, operations of calibrating luminance of the organic EL display device 21 of a portable cellular phone having configurations described above based on an amount of light incident from an outside will be described. As explained in the conventional case, the organic EL display device 21 has a characteristic that its luminance changes approximately in proportion to a change in applied voltage. Moreover, generally, luminance required for a user of the portable cellular phone to recognize contents displayed in the organic EL display device 21 changes approximately in proportion to a change in an amount of light fed from the outside That is, in strong light from the outside, unless luminance of the organic EL display device 21 is sufficiently raised, the user cannot recognize a displayed content, however, in the outdoors during the night or a dimly lit room, even if luminance of the organic EL display device 21 is lowered, the user can sufficiently recognize the displayed content. The optical sensor 24 of the embodiment measures an amount of light being substantially proportional to that of light incident on the organic EL display device 21 and outputs the analog light amount voltage $V_L$ corresponding to the amount of light. FIG. 4 shows an example of a characteristic of the analog light amount voltage $V_L$ corresponding to an amount of light to an amount of light received by the optical sensor 24. As shown in FIG. 4, the amount of light received by the optical sensor 24 is approximately proportional to the analog light amount voltage $V_L$.

However, in the embodiment, such an A/D converter 5 and a memory 8 as employed in the conventional technology are not used. Instead, the FETs Q1 and Q2 respectively having their gate cut-off voltages $V_{T1}$ and $V_{T2}$ as shown in FIG. 4 to the analog light amount voltage $V_L$ of the optical sensor 24 are employed and, in the characteristic curve of the amount of light received by the optical sensor 24 to the voltage as shown in FIG. 4, the amount of received light corresponding to the gate cut-off voltages $V_{T1}$ and $V_{T2}$, is divided into three level ranges including boundary values 0 to TH1, boundary values TH1 to TH2, and boundary values TH2~. when the analog light amount voltage $V_L$ produced by the optical sensor 24 corresponding to an amount of light received thereby exceeds the gate cut-off voltages $V_{T1}$ and $V_{T2}$ in accordance with an increase in the amount of light, the FETs Q1 and Q2 are turned ON. In order to divide the output voltage $V_{OUT}$ to be applied to the organic EL display device 21 by using above changes in the light amount voltage and the gate cut-off voltage into three level ranges, the output voltage dividing section 25 is incorporated as shown in FIG. 1 and each of resistance values R1 to R4 corresponding to each of resistors 61 to 64 is set to a specified value.

FIG. 5 is a table showing an example of a relation among the amount of light received by the optical sensor 24, ON/OFF state of the FETs Q1 and Q2, and dividing ratio of an output voltage $V_{OUT}$. As shown in FIG. 5, in a state ST1 in which an amount of light received by the optical sensor 24 is in a range of boundary values 0 to TH1, since the FETs Q1 and Q2 are in an OFF state, the dividing ratio of the output voltage $V_{OUT}$ is R2/(R1+R2) Similarly, in a state ST2 in which the amount of light received by the optical sensor 24 is in a level range of boundary values TH1 to TH2, though the FET Q1 becomes in an ON state, since the FET Q2 is in an OFF state, the dividing ratio of the output voltage $V_{OUT}$ is RX1/(R1+RX1). Here, RX1 is given by a following Equation (1):

$$RX1=R2\cdot R3/(R2+R3) \quad \text{Equation (1)}$$

Moreover, in a state ST3 in which the amount of light received by the optical sensor 24 is in a range of boundary values TH2~, since both the FETs Q1 and Q2 are in an ON state, the dividing ratio of the output voltage $V_{OUT}$ is RX2/(R1+RX2). Here, RX2 is given by a following Equation (2):

$$RX\ 2=R2\cdot R3\cdot R4/(R2\cdot R3+R3\cdot R4+R4\cdot R2) \quad \text{Equation (2)}$$

For example, if each of resistance values R1 to R4 is respectively 30 kΩ, 50 kΩ, 75 kΩ, and 30 kΩ and if a reference voltage $V_{REF}$ is 5 V, the voltage dividing ratio {R2/(R1+R2)} is 5/8, voltage dividing ratio {RX1/(R1+RX1)} is 5/10, and voltage dividing ratio {RX2/(R1+RX2)} is 5/15.

The output voltage dividing section 25 feeds a divided voltage $V_D$ obtained by dividing an output voltage $V_{OUT}$ based on the analog light amount voltage $V_L$ to the organic EL display power source 22. As a result, the organic EL display power source 22 produces, based on the divided voltage $V_D$, a high output voltage $V_{OUT}$ used to drive the organic EL display device 21, from a supply power fed from the power source 23 and feeds it to the organic EL display device 21. Therefore, an output voltage $V_{OUT}$ being as low as possible to reduce power consumption is applied to the organic EL display device 21.

For example, when a portable cellular phone is used in the outdoors during the night or in a dimly lit room, in the case of the state ST1 in which an amount of light received by the optical sensor 24 is in a range of boundary values 0 to TH1, since both the FET Q1 and FET Q2 are in the OFF state, the voltage dividing ratio {R2/(R1+R2)} of the output voltage $V_{OUT}$ is 5/8 in the example. Therefore, since the output voltage $V_{OUT}$ fed to the organic EL display device 21 becomes 8 V, the organic EL display device 21 provides luminance corresponding to the output voltage $V_{OUT}$ of 8 V. Also, when the portable cellular phone is used outdoors in a cloudy sky in a daytime or indoors in appropriate illumination, in the case of the state ST2 in which an amount of light received by the optical sensor 24 is in a range of boundary values TH1 to TH2, though the FET Q1 becomes in the ON state, since the FET Q2 still remains in the OFF state, a voltage dividing ratio RX1/(R1+RX1) is 5/10 in the example. Therefore, since the output voltage $V_{OUT}$ to be fed to the organic EL display device 21 becomes 10 V, the organic EL display device 21 provides luminance corresponding to the output voltage $V_{OUT}$ being 10 V. Furthermore, when the portable cellular phone is used outdoors in a clear sky in a daytime or indoors in direct illumination, in the case of the state ST3 in which an amount of light received by the optical sensor 24 is in a range of boundary values TH2~, since both the FETs Q1 and Q2 are in the ON state, a voltage dividing ratio RX2/(R1+RX2) is 5/15 in the example. Therefore, since the output voltage $V_{OUT}$ to be fed to the organic EL display 21 becomes 15 V, the organic EL display device 21 provides luminance corresponding to the output voltage $V_{OUT}$ being 15 V.

Thus, according to the embodiment, the organic EL display power source 22, based a divided voltage $V_D$ generated by an output voltage dividing section 25 made up of resistors 61 to 64 and FETs Q1 and Q2, produces the output voltage $V_{OUT}$, and feeds it to the organic EL display device 21. Therefore, the method of the embodiment, unlike in the conventional case in which an output voltage dividing section 6 made up of CPUs, based on data fed from the A/D converting section 5 and the memory 8, controls periodically an organic EL display power source section 2, neither puts a load on the CPUs nor requires incorporation of the A/D converting section 5 and the memory 8. As a result, the driving circuit for the display including that embedded in portable cellular phones can be configured so as to be simple and low-priced without putting a load on the CPU, thus achieving reduction in power consumption.

Second Embodiment

Figure 6:
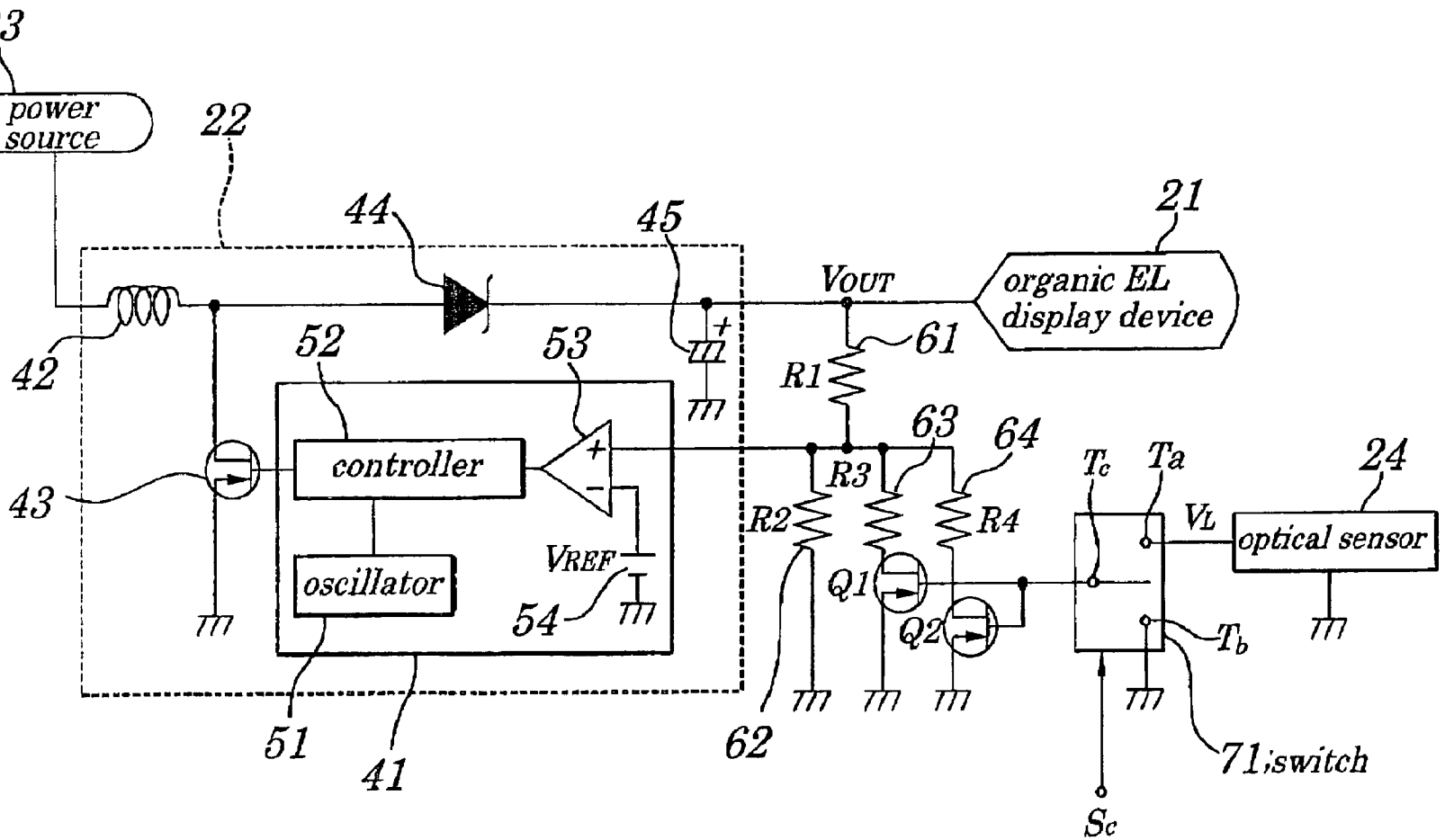
FIG. 6 is a schematic block diagram showing configurations of a driving circuit of a display employing a method of calibrating luminance of the display according to a second embodiment of the present invention.
Figure 7:
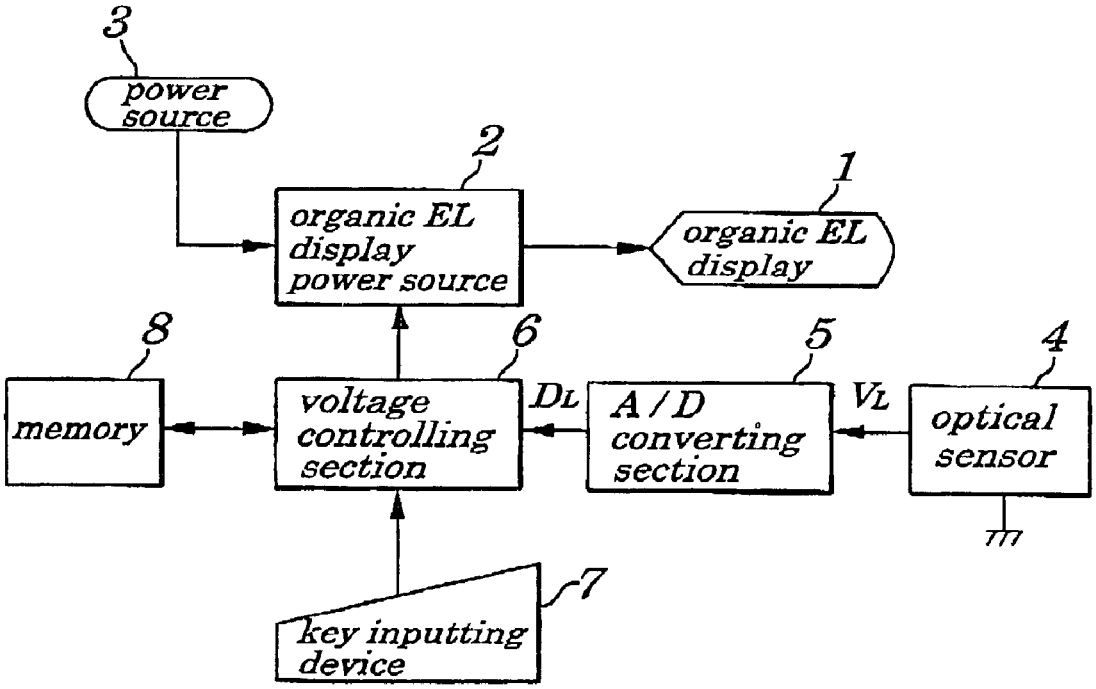
FIG. 7 (PRIOR ART)
FIG. 7 is a block diagram showing an example of configurations of a conventional driving circuit of a display.
Figure 8:
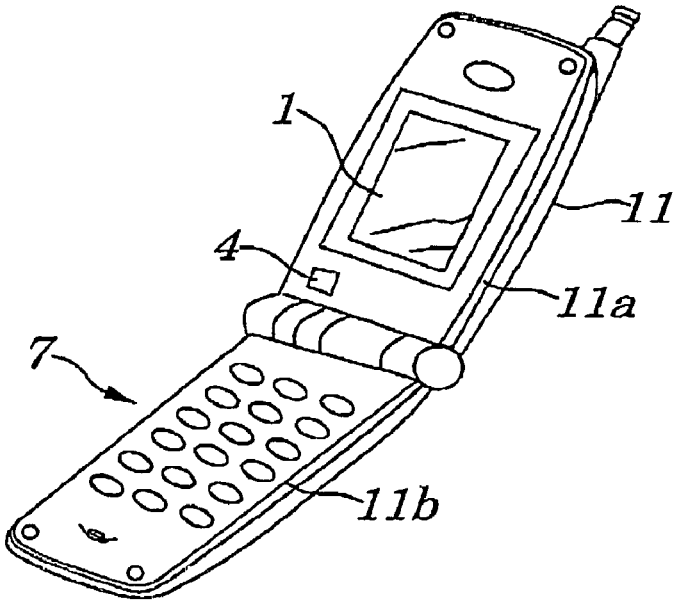
FIG. 8 (PRIOR ART)
FIG. 8 is a perspective view showing an appearance of a portable cellular phone being equipped with the above conventional driving circuit of the display of FIG. 7.

FIG. 6 is a schematic block diagram showing configurations of a driving circuit for a organic EL display device 21 employing a method of calibrating luminance of the display according to the second embodiment of the present invention. In FIG. 6, same reference numbers are assigned to each of components having same function as those shown in FIG. 1 and their descriptions are omitted accordingly. In the driving circuit for the organic EL display device 21 shown in FIG. 6, a switch 71 is newly provided between an output terminal of an optical sensor 24 and a connection point of each gate of the FETs Q1 and Q2. A common terminal $T_c$ of the switch 71 is connected to a connection point of each gate of FET Q1 and Q2 while a terminal $T_a$ of the switch 71 is connected to an output terminal of the optical sensor 24. A terminal $T_b$ of the switch 71 is grounded. The common terminal $T_c$ of the switch 71, based on a control signal $S_c$ fed from the CPU adapted to control each component of a portable cellular phone, is connected to either of its terminal $T_a$ or its terminal $T_b$.

A CPU, when the portable cellular phone has been set to a silent (manner) mode, a conversation mode, or a waiting mode, in order to connect the common terminal $T_c$ of the switch 71 to its terminal $T_b$, feeds, for example, a low-level control signal $S_c$. The silent mode is used to set so that an incoming call does not ring while a user of the portable cellular phone takes a ride on the train or the user stays in a comparatively calm and public place such as a library. The conversation mode is used to take a conversation between the user of the portable cellular phone and a destination of a call from the portable cellular phone. Moreover, the waiting mode is used to wait for a coming call while power is applied to the portable cellular phone, however, no operation is performed by the user When the portable cellular phone has been set to the silent mode, the conversation mode, or the waiting mode, since no user sees a screen of the organic EL display 21, the CPU forcedly sets a state so as to be same as a state ST, causing the common terminal $T_c$ of the switch 71 to be connected to the terminal $T_b$.

In cases where modes other than the silent mode, the conversation mode, or the waiting mode are used, when the user, while viewing a screen of the organic EL display device 21, inputs telephone numbers or E-mail characters or makes a reference to contents, which are displayed on the organic EL display device 21, provided by various contents providers of a WWW (World Wide Web) server, the CPU, in order to connect the common terminal $T_c$ of the switch 71 to the terminal $T_a$, feeds, for example, the high-level control signal $S_c$. In this case, operations being the same as those in the first embodiment are performed. As described above, according to the embodiment, since the switch 71 is provided between an output terminal of the optical sensor 24 and the connection points of each gate of the FETs Q1 and Q2, effects obtained in the first embodiment can be achieved and power consumption can be more reduced.

It is apparent that the present invention is not limited to the above embodiments but may be changed and modified without departing from the scope and spirit of the invention. For example, in each of the above embodiments, the solar cell is used as an optical sensor 24, however, other optical sensors having a specified relation in a characteristic of an analog light amount voltage $V_L$ to an amount of received light, for example, a proportional relation, inversely proportional relation, or nonlinear relation may be employed. As other optical sensors, for example, a cadmium sulfide (CdS), a photodiode, a phototransistor, or a like may be used. Moreover, if an optical sensor adapted to receive light to generate a current is used, though a current-to-voltage converter adapted to convert a current to a voltage is required, unlike in the conventional case where the CPU, A/D converter, and memory are used, it can be configured to be simple and low-cost.

Also, in each of the above embodiments, the optical sensor 24 is placed inside the upper portion 31*a*, of the housing 31 of a portable cellular phone shown in FIG. 2 and on a surface existing in the vicinity of a left lower portion of the organic EL display device 21. However, the optical sensor 24 can be placed inside the upper portion 31*a* of the housing 31 and left below, right upper, left upper of the organic EL display device 21, or in an outer edge portion or a like of the organic EL display device 21, that is, in a place where an amount of light corresponding to an amount of light incident on the organic EL display device 21 can be measured.

Also, in each of the above embodiments, two FETs Q1 and Q2 one having a gate cut-off voltage $V_{T1}$ and another having a gate cut-off voltage $V_{T2}$ are used, however, one FET may be employed or three, four, and five or more FETs each having a different gate cut-off voltage maybe also used. If a number of the FETs is larger, luminance of the organic EL display device 21 can be changed more smoothly.

Also, in each of the above embodiments, two FETs Q1 and Q2 one having the gate cut-off voltage $V_{T1}$ and another having the gate cut-off voltage $V_{T2}$ are used, however, one or a plurality of bipolar transistors each having a different cut-off voltage can be used.

Also, in each of the above embodiments, luminance of the organic EL display device 21 is automatically calibrated, however, by a user manipulating a key or button mounted in a key inputting device, the FET Q1 or Q2 may be forcedly turned ON and OFF to calibrate luminance of the organic EL display device 21.

Also, in each of the above embodiments, the present invention is applied to the driving circuit of the display to drive the organic EL display device 21, however, the present invention may be applied to a display which is made up of light emitting devices and whose luminance is changed by an applied voltage. Such the display includes a display made up of light emitting diodes or a display made up of a VFD (Vacuum Fluorescent Display) (in particular, an FED, that is, Field Emission Display being one of the VFD), or a like.

Furthermore, in each of the above embodiments, the present invention is applied to portable cellular phones, however, the present invention may be applied to other portable electronic devices using a battery or dry cell as a power source such as notebook computers, palm-sized computers, pocket-sized computers, PDA (Personal Digital Assistant), PHS (Personal Handy-phone System) or a like.

What is claimed is:

1. A method for calibrating luminance of a display comprising:

a step of measuring an amount of light corresponding to an amount of light incident on said display whose luminance is changed depending on an applied voltage;

a step of dividing said applied voltage with a voltage obtained as a result of the measurement;

a step of adjusting said applied voltage based on the divided voltage, and a step of providing transistors with different cut-off voltages, and wherein the step of dividing the applied voltage comprises the step of turning ON and OFF the transistors based on the voltage obtained as a result of the measurement.

2. The method for calibrating luminance of the display according to claim 1, wherein said divided voltage is set at a specified value based on a signal fed from an outside.

3. The method for calibrating luminance of the display according to claim 1, wherein said display is any one of an organic electroluminescence display, a display made up of a Light-Emitting Diode (LED), a display made up of a Vacuum Fluorescent Display (VFD), and a Field Emission Display (FED).

4. A driving circuit for a display comprising;

an optical sensor to measure an amount of light corresponding to an amount of light incident on a display whose luminance is changed depending on an applied voltage and to output a voltage corresponding to the measured amount of light;

a power source section to produce said applied voltage;

a voltage dividing section that divides said applied voltage with said voltage corresponding to the measured amount of light and feeds the divided voltage to said power source section; and wherein said power source section calibrates said applied voltage based on said divided voltage, and wherein said voltage dividing section is made up of a plurality of resistors, and one transistor or a plurality of transistors each having a different cut-off voltage and wherein said voltage dividing section outputs the different divided voltage by turning ON and OFF said transistor based on said voltage corresponding to said measured amount of light to make different a synthetic resistance value produced by said plurality of resistors.

5. The driving circuit of the display according to claim 4, wherein said display is any one of an organic electroluminescence display, a display made up of a Light-Emitting Diode (LED), a display made up of a Vacuum Fluorescent Display (VFD), and a Field Emission Display (FED).

6. A driving circuit for a display comprising:

an optical sensor to measure an amount of light corresponding to an amount of light incident on a display whose luminance is changed depending on an applied voltage and to output a voltage corresponding to the measured amount of light;

a power source section to produce said applied voltage;

a voltage dividing section that divides said applied voltage with said voltage corresponding to the measured amount of light and feeds the divided voltage to said power source section; and a switch being placed between an output terminal of said optical sensor and an input terminal of said voltage dividing section to set said divided voltage to a specified value based on a signal fed from an outside, wherein said power source section calibrates said applied voltage based on said divided voltage.

7. A portable electronic device being provided with a driving circuit for a display, said driving circuit comprising;

an optical sensor to measure an amount of light corresponding to an amount of light incident on a display whose luminance is changed depending on an applied voltage and to output a voltage corresponding to the measured amount of light;

a power source section to produce said applied voltage;

a voltage dividing section that divides said applied voltage with said voltage corresponding to the measured amount of light and feeds the divided voltage to said power source section; and wherein said power source section calibrates said applied voltage based on said divided voltage, and wherein said voltage dividing section is made up of a plurality of resistors, and one transistor or a plurality of transistors each having a different cut-off voltage and wherein said voltage dividing section outputs the different divided voltage by turning ON and OFF said transistor based on said voltage corresponding to said measured amount of light to make different a synthetic resistance value produced by said plurality of resistors.

8. The portable electronic device according to claim 7, wherein said display is any one of an organic electroluminescence display, a display made up of a Light-Emitting Diode (LED), a display made up of a Vacuum Fluorescent Display (VFD), and a Field Emission Display (FED).

9. A portable electronic device being provided with a driving circuit for a display, said driving circuit comprising:

an optical sensor to measure an amount of light corresponding to an amount of light incident on a display whose luminance is changed depending on an applied voltage and to output a voltage corresponding to the measured amount of light;

a power source section to produce said applied voltage;

a voltage dividing section that divides said applied voltage with said voltage corresponding to the measured amount of light and feeds the divided voltage to said power source section; and a switch being placed between an output terminal of said optical sensor and an input terminal of said voltage dividing section to set said divided voltage to a specified value based on a signal fed from an outside, wherein said power source section calibrates said applied voltage based on said divided voltage.

10. The portable electronic device according to claim 9, wherein said signal is fed when said portable electronic device is in a silent mode to cause an incoming call not to ring, in a conversation mode to cause a telephone conversation to be taken between a user of said portable electronic device and another user of said portable electronic device receiving a call, or in a waiting mode in which, though power is turned ON, said user is waiting for an incoming signal without performing operations, or when said user is operating said portable electronic device.

11. The portable electronic device according to claim 10, comprising a portable cellular phone or a simplified portable cellular phone.

12. A method for calibrating luminance of a display comprising:

a step of measuring an amount of light corresponding to an amount of light incident on said display whose luminance is changed depending on an applied voltage;

a step of dividing said applied voltage with a voltage obtained as a result of the measurement;

a step of adjusting said applied voltage based on the divided voltage; and a step of selectively switching OFF the voltage obtained as a result of the measurement to selectively disable the step of dividing the applied voltage.

* * * * *